US006815922B2

(12) United States Patent
Yoo et al.

(10) Patent No.: US 6,815,922 B2
(45) Date of Patent: Nov. 9, 2004

(54) APPARATUS AND METHOD FOR CONTROLLING OPERATION OF COMPRESSOR

(75) Inventors: Jae Yoo Yoo, Gyeonggi-Do (KR); Chel Woong Lee, Seoul (KR); Ji Won Sung, Seoul (KR); Hyuk Lee, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 13 days.

(21) Appl. No.: 10/406,307

(22) Filed: Apr. 4, 2003

(65) Prior Publication Data

US 2004/0066163 A1 Apr. 8, 2004

(30) Foreign Application Priority Data

Oct. 4, 2002 (KR) ..... 2002-60729

(51) Int. Cl.[7] ..... G05D 23/275; H02P 1/00; F04B 49/06

(52) U.S. Cl. ..... 318/632; 318/556; 417/44.1; 417/45; 417/44.11; 417/53; 62/6; 62/228.1; 62/156

(58) Field of Search ..... 318/632, 628, 318/556; 417/44.1, 44.11, 53, 45; 62/6, 230, 228.1

(56) References Cited

U.S. PATENT DOCUMENTS 5,342,176 A * 8/1994 Redlich ..... 417/212
6,028,406 A * 2/2000 Birk ..... 318/254
6,176,683 B1 * 1/2001 Yang ..... 417/44.1
6,289,680 B1 * 9/2001 Oh et al. ..... 62/6
6,437,034 B2 * 8/2002 Lombardi et al. ..... 524/425
6,520,746 B2 * 2/2003 Yoo et al. ..... 417/44.11
6,524,075 B2 * 2/2003 Hwang et al. ..... 417/44.11
6,541,953 B2 * 4/2003 Yoo et al. ..... 324/76.52
6,554,577 B2 * 4/2003 Park et al. ..... 417/44.1
6,616,414 B2 * 9/2003 Yoo et al. ..... 417/44.1
6,623,246 B2 * 9/2003 Hwang et al. ..... 417/44.1
6,682,310 B2 * 1/2004 Yoo et al. ..... 417/42
6,715,301 B2 * 4/2004 Song ..... 62/6
6,735,284 B2 * 5/2004 Cheong et al. ..... 318/801
2002/0051710 A1 * 5/2002 Yoo et al. ..... 417/44.11
2002/0064462 A1 * 5/2002 Park et al. ..... 417/44.1
2002/0064463 A1 * 5/2002 Park et al. ..... 417/44.1
2002/0064464 A1 * 5/2002 Hwang et al. ..... 417/44.11

(List continued on next page.)

*Primary Examiner*—Paul Ip
(74) *Attorney, Agent, or Firm*—Greenblum & Bernstein, P.L.C.

(57) ABSTRACT

An apparatus and a method are disclosed for controlling operation of a compressor capable of greatly decreasing a stroke estimation error of a compressor and controlling operation of the compressor accurately and precisely. The method includes calculating a first stroke estimation value of a compressor on the basis of current, a voltage applied to a motor of a compressor and preset parameters of the motor. Detecting a counter electromotive force of the motor and calculating a second stroke estimation value of the compressor on the basis of the detected counter electromotive force value. Determining a new stroke reference value by comparing the first stroke estimation value with the second stroke estimation value, adding or subtracting a stroke compensation value corresponding to the comparison result to or from a preset stroke reference value, and controlling a stroke of the compressor by varying a voltage applied to the motor on the basis of the determined stroke reference value and the first stroke estimation value.

15 Claims, 4 Drawing Sheets

U.S. PATENT DOCUMENTS

2002/0090304 A1 * 7/2002 Yoo et al. ..... 417/44.1
2002/0093327 A1 * 7/2002 Yoo et al. ..... 324/76.52
2002/0113565 A1 * 8/2002 Kim et al. ..... 318/556
2002/0150477 A1 * 10/2002 Hwang et al. ..... 417/44.1
2003/0026701 A1 * 2/2003 Yoo et al. ..... 417/42
2003/0026702 A1 * 2/2003 Yoo et al. ..... 417/44.11
2003/0175125 A1 * 9/2003 Kwon et al. ..... 417/44.11
2003/0177773 A1 * 9/2003 Kim ..... 62/156
2003/0180151 A1 * 9/2003 Jeun ..... 417/44.11
2003/0209015 A1 * 11/2003 Song ..... 62/6
2003/0218854 A1 * 11/2003 Dimanstein ..... 361/187
2004/0071556 A1 * 4/2004 Sung et al. ..... 417/44.1

* cited by examiner

APPARATUS AND METHOD FOR CONTROLLING OPERATION OF COMPRESSOR

CROSS-REFERENCE TO RELATED APPLICATION

The present disclosure is related to subject matter contained in Korean Patent Application No. 60729/2002, filed on Oct. 4, 2002, which is expressly incorporated herewith, by reference, in, its entirety

BACKGROUND OF THE INVENTION

1. Field of the Invention

The present invention relates to a compressor. In particular the present invention relates to an apparatus and a method for accurately controlling operation of a reciprocating compressor by reducing a stroke estimation error of a reciprocating compressor.

2. Description of the Prior Art

FIG. 1 is a block diagram illustrating a construction of an operation control apparatus of a reciprocating compressor in accordance with the conventional art.

As depicted in FIG. 1, the operation control apparatus of the reciprocating compressor includes a current detector 4 for detecting current applied to a motor (not shown) of a reciprocating compressor 6; a voltage detector 3 for detecting a voltage applied to the motor; a stroke calculator 5 for calculating a stroke estimation value of the compressor 6 on the basis of the detected current, voltage and parameters of the motor; a comparator 1 for comparing the calculated stroke estimation value with a preset stroke reference value and outputting a difference value according to the comparison result; and a stroke controller 2 for controlling a stroke of the compressor 6 by varying a voltage applied to the motor in accordance with the difference value. Hereinafter, the operation of the operation control apparatus of the reciprocating compressor will be described.

First, the current detector 4 detects current applied to the motor of the compressor 6 and outputs the detected current to the stroke calculator 5. Also, the voltage detector 3 detects a voltage applied to the motor and outputs the detected voltage value to the stroke calculator 5.

The stroke calculator 5 calculates a stroke estimation value of the compressor with Equation 1 by substituting the detected current value, the detected voltage value and the parameters of the motor and applies the calculated stroke estimation value to the comparator 1.

$$X = \frac{1}{\alpha}\int (V_M - Ri - L\dot{i})dt \qquad \text{Equation 1}$$

where R is resistance, L is inductance, $\alpha$ is a motor constant, $V_M$ is a voltage applied to the motor, i is current applied to the motor, and $\dot{i}$ is a time variation rate of current applied to the motor. In particular, $\dot{i}$ is a differential value (di/dt) of i.

Afterward, the comparator 1 compares the stroke estimation value with the stroke reference value and applies a difference value according to the comparison result to the stroke controller 2.

The stroke controller 2 controls a stroke by varying the voltage applied to the motor of the compressor 6 on the basis of the difference value, It will be described in detail with reference to accompanying FIG. 2.

FIG. 2 is a flow chart illustrating an operation control method of the reciprocating compressor in accordance with the conventional art.

First, when a stroke estimation value is applied from the stroke calculator 5 to the comparator 1 as shown at step S1, the comparator 1 compares the stroke estimation value with a stroke reference value and outputs a difference value according to the comparison result to the stroke controller 2 as shown at step S2.

When the stroke estimation value is less than the stroke reference value (S2, YES), the stroke controller 2 increases a voltage applied to the motor in order to control a stroke of the compressor 6 as shown at step S3. On the other hand, when the stroke estimation value is greater than the stroke reference value (S2, NO), the stroke controller 2 decreases a voltage applied to the motor as shown at step S4.

As described above, in the apparatus and the method for controlling operation of the reciprocating compressor in accordance with the conventional art, a stroke estimation value is calculated by using parameters (motor constant, resistance, inductance) of the motor, and a stroke of the compressor is controlled on the basis of the calculated stroke estimation value. Accordingly, an error in the calculated stroke estimation value can increase due to deviation of the parameters of the motor (in particular, resistance and inductance) from the standard values and due to non-linearity.

In addition, in the apparatus and the method for controlling operation of the reciprocating compressor in accordance with the conventional art, because an error in the calculated stroke estimation value can be large, it is impossible to control operation of the compressor accurately or precisely.

SUMMARY OF THE INVENTION

In order to solve the above-mentioned problem, it is an object of the present invention to provide an apparatus and a method for controlling operation of a compressor capable of greatly decreasing an error in a stroke estimation value of a compressor by comparing a first stroke estimation value calculated on the basis of a current, a voltage applied to a motor of the compressor and parameters of the motor with a second stroke estimation value calculated on the basis of a counter electromotive force.

It is another object of the present invention to provide an apparatus and a method for controlling operation of a compressor capable of controlling operation of a compressor accurately and precisely by compensating a preset stroke reference value on the basis of a first stroke estimation value and a second stroke estimation value, comparing the compensated stroke reference value with the first stroke estimation value and controlling operation of the compressor according to the comparison result.

In order to achieve the above-mentioned object, a method for controlling operation of a compressor in accordance with the present invention includes calculating a first stroke estimation value of a compressor on the basis of a current, a voltage applied to a motor of a compressor and preset parameters of the motor; detecting a counter electromotive force of the motor; calculating a second stroke estimation value of the compressor on the basis of the detected counter electromotive force value; determining a new stroke reference value by comparing the first stroke estimation value with the second stroke estimation value, adding or subtracting a stroke compensation value corresponding to the comparison result to or from a preset stroke reference value; and controlling a stroke of the compressor by varying a voltage applied to the motor on the basis of the determined stroke reference value and the first stroke estimation value.

In order to achieve the above-mentioned object, an apparatus for controlling operation of a compressor in accordance with the present invention includes a detector for detecting a current and a voltage applied to a motor of a compressor; a first stroke calculator for calculating a first stroke estimation value of the compressor on the basis of the detected current value, voltage value and preset parameters of the motor; a counter electromotive force detector for detecting a counter electromotive force of the motor; a second stroke calculator for calculating a second stroke estimation value of the compressor on the basis of the counter electromotive force; a stroke compensation value calculator for calculating a stroke compensation value on the basis of the first stroke estimation value and the second stroke estimation value; a stroke reference value determiner for adding or subtracting the stroke compensation value to or from a preset stroke reference value and determining the added or subtracted stroke reference value as a new stroke reference value; and a stroke controller for controlling a stroke of the compressor by varying a voltage applied to the motor on the basis of the first stroke estimation value and the determined stroke reference value,

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of an apparatus and a method for controlling operation of a compressor in accordance with the present invention capable of greatly decreasing a stroke estimation error of a compressor and controlling operation of the compressor accurately and precisely is presented. The present invention controls operation of the compressor by calculating a first stroke estimation value of the compressor on the basis of a volt age, current and preset parameters of a motor; detecting a counter electromotive force of the motor; calculating a second stroke estimation value of the compressor on the basis of the detected counter electromotive force; comparing the first stroke estimation value with the second stroke estimation value; determining a new stroke reference value by adding or subtracting a stroke compensation value corresponding to the comparison result to/from a preset stroke reference value; and controlling a stroke of the compressor by varying a voltage applied to the motor on the basis of the determined stroke reference value and the first stroke estimation value. The present invention will be described in detail with reference to accompanying FIGS. 3–5.

Figure 1:
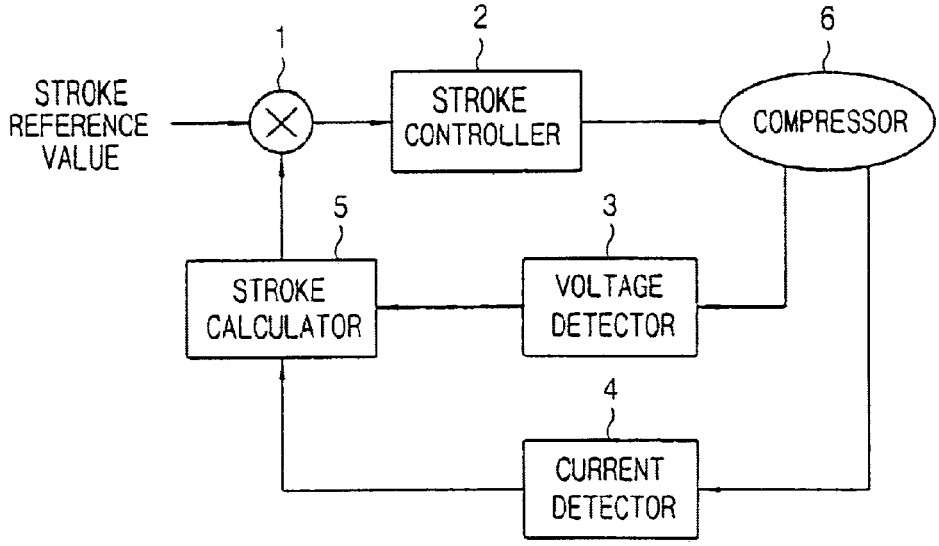
FIG. 1 CONVENTIONAL ART
FIG. 1 is a block diagram illustrating a construction of an operation control apparatus of a reciprocating compressor in accordance with the conventional art.
Figure 2:
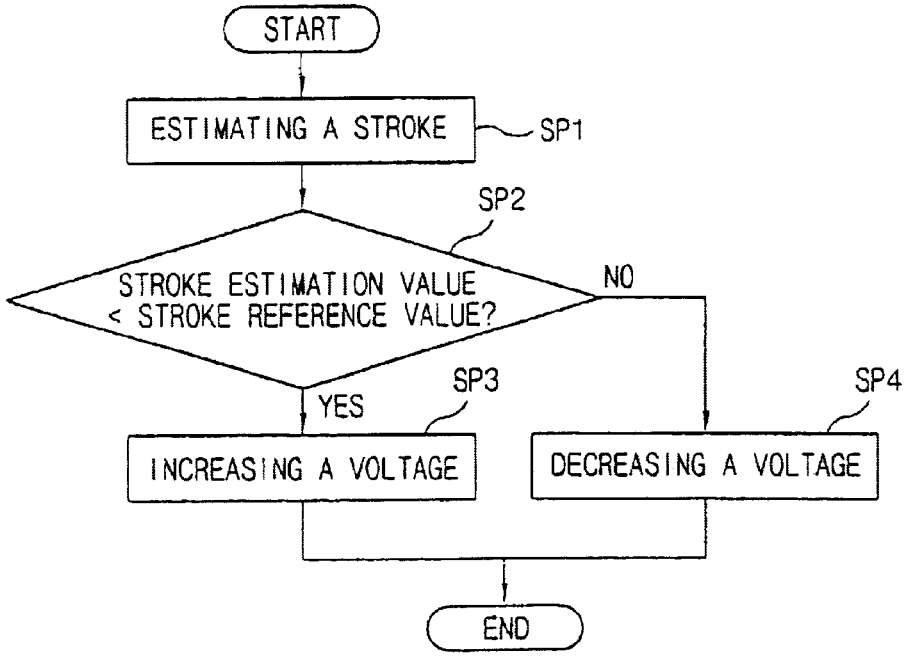
FIG. 2 CONVENTIONAL ART
FIG. 2 is a flow chart illustrating an operation control method of a reciprocating compressor in accordance with the conventional art.
Figure 3:
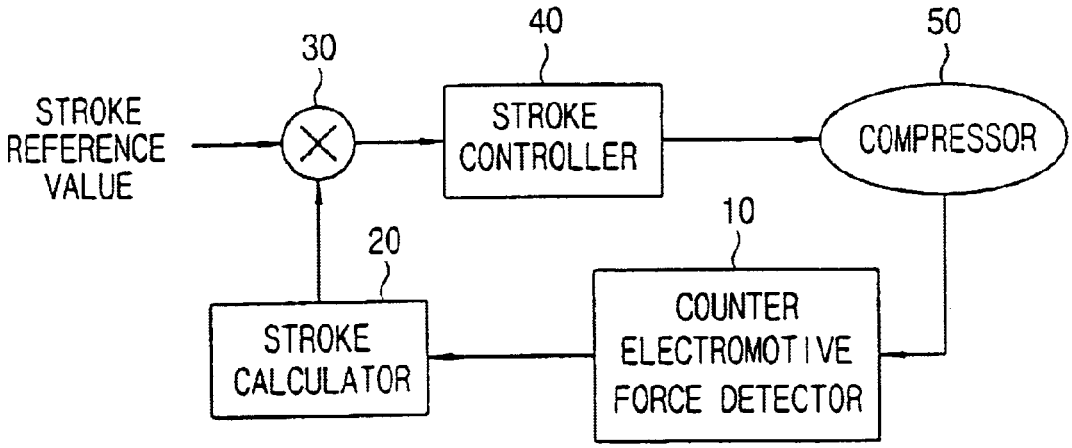
FIG. 3 is a block diagram illustrating a construction of an operation control apparatus of a reciprocating compressor in accordance with the present invention.
Figure 4:
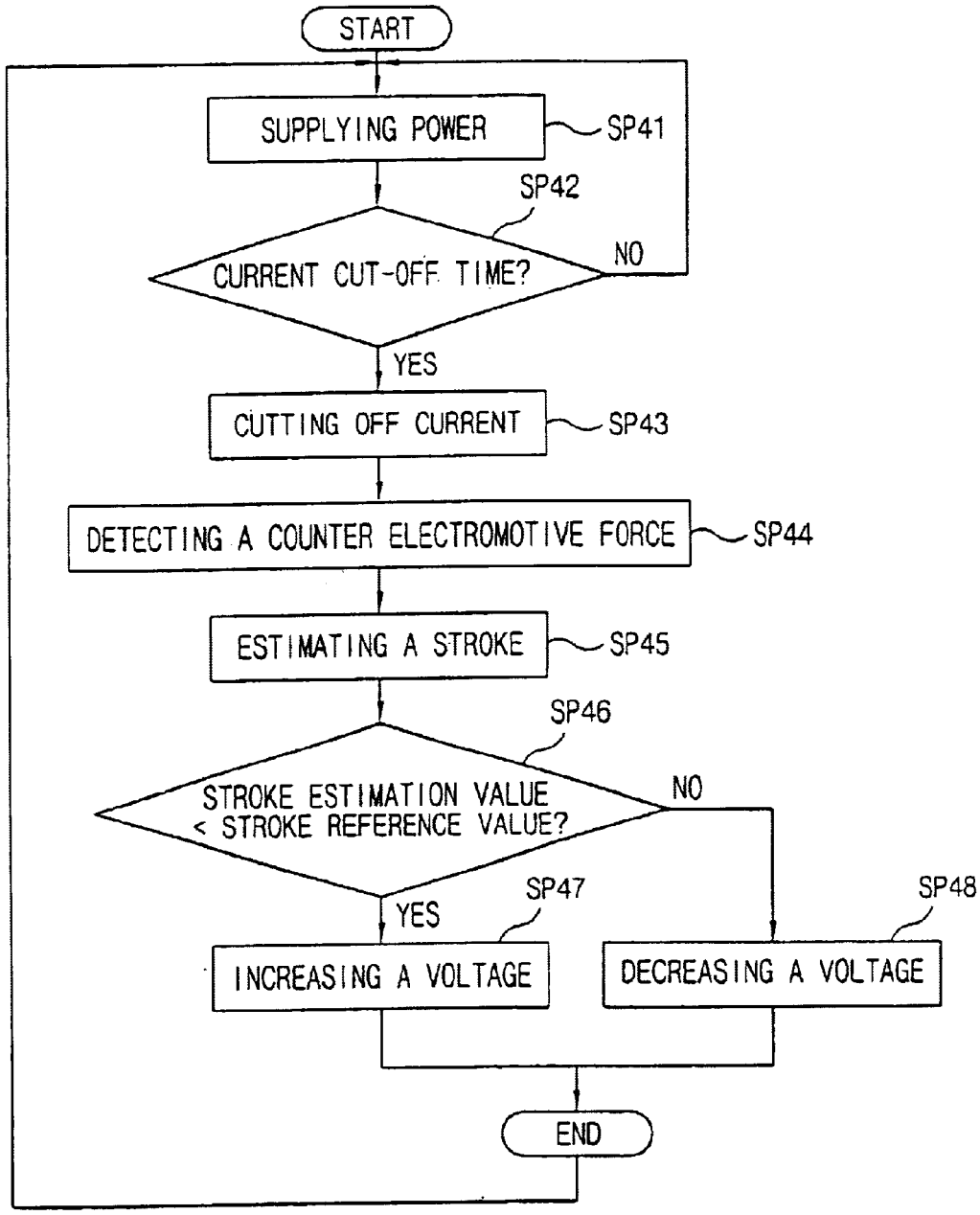
FIG. 4 is a flow chart illustrating an operation control method of a reciprocating compressor in accordance with the present invention.

FIG. 3 is a block diagram illustrating a construction of an operation control apparatus of a reciprocating compressor in accordance with the present invention.

As depicted in FIG. 3, the operation control apparatus of the reciprocating compressor includes a voltage detector 60 for detecting a voltage applied to a motor (not shown) of a compressor 100; a current detector 70 for detecting current applied to the motor of the compressor 100; a first stroke calculator 50 for calculating a first stroke estimation value (×1) of the compressor 100 on the basis of the detected current value, voltage value and preset parameters of the motor; a counter electromotive force detector 80 for cutting off current applied to the motor for a certain or predetermined period and detecting a counter electromotive force of the motor for the current cut-off period; a second stroke calculator 90 for calculating a second stroke estimation value (×2) of the compressor 100 on the basis of the counter electromotive force value detected by the counter electromotive force detector 80; a stroke compensation value calculator 20 for multiplying a certain or predetermined amplification ratio by the first stroke estimation value, comparing the multiplied first stroke estimation value with the second stroke estimation value and calculating a stroke compensation value according to the comparison result; a stroke reference value determiner 10 for adding/subtracting the stroke compensation value to/from a preset stroke reference value and determining or defining the added/subtracted stroke reference value as a new stroke reference value; a comparator 30 for comparing the determined stroke reference value with the first stroke estimation value and outputting a difference value according to the comparison result; and a stroke controller 40 for controlling a stroke of the compressor 100 by varying a voltage applied to the motor on the basis of the difference value outputted from the comparator 30. Hereinafter, operation of the operation control apparatus of the compressor in accordance with the present invention will be described.

First, the current detector 70 detects current applied to the motor of the compressor 100 and outputs the detected current value to the first stroke calculator 50. Further, the voltage detector 60 detects a voltage applied to the motor of the compressor 100 and outputs the detected voltage value to the first stroke calculator 50 as shown at step S11.

The first stroke calculator 50 calculates a first stroke estimation value of the compressor 100 by substituting the detected current value, voltage value and preset parameters of the motor in the following Equation 1 and applying the calculated first stroke estimation value to the comparator 30 and the stroke compensation value calculator 20 as shown at step S12.

$$X = \frac{1}{\alpha}\int (V_M - Ri - L\dot{i})dt \qquad \text{Equation 1}$$

wherein R is resistance, L is inductance, $\alpha$ is a motor constant, $V_M$ is a voltage applied to the motor, i is current applied to the motor, and $\dot{i}$ is a time variation rate of current applied to the motor. In particular, $\dot{i}$ is a differential value (di/dt) of i.

The comparator 30 compares the first stroke estimation value with the preset stroke reference value and applies a difference value according to the comparison result to the stroke controller 40 as shown at step S13. Herein, the stroke controller 40 controls a stroke by varying a voltage applied to the motor of the compressor 100 on the basis of the difference value. In more detail, when the first stroke estimation value is less than the stroke reference value, the stroke controller 40 increases a voltage applied to the motor in order to control a stroke of the compressor 100, and when the first stroke estimation value is greater than the stroke reference value, the stroke controller 40 decreases a voltage applied to the motor as shown at steps S14 and S15.

Afterward, when a current cut-off period (lime) preset by a user has passed while a stroke of the compressor 100 is controlled with the varied voltage as shown at step S16, the counter electromotive force detector 80 cuts off current applied to the motor for a predetermined or certain period of time, detects a counter electromotive force of the motor for the current cut-off period and outputs the detected counter electromotive force value to the second stroke calculator 90 as shown at steps S17–S19. The counter electromotive force value detected by the counter electromotive force detector 80 is the same as a value calculated by the following Equation 2.

$$\text{Counter electromotive force}=\alpha\bar{x} \qquad \text{Equation 2}$$

wherein $\alpha$ is a motor constant, and $\bar{x}$ is a piston speed of the compressor.

Thereafter, the second stroke calculator 90 substitutes the detected counter electromotive force value in following Equation 3, calculates a second stroke estimation value (X) and applies the calculated second stroke estimation value (X) to the stroke compensation value calculator 20 as shown at S20.

$$X = \frac{1}{\alpha}\int(\alpha\bar{x})dt \qquad \text{Equation 3}$$

The stroke compensation value calculator 20 multiplies a certain or predetermined amplification ratio with the first stroke estimation value output from the first stroke calculator 50, compares the multiplied first stroke estimation value with the second stroke estimation value output from the second stroke calculator 90 and outputs a stroke compensation value corresponding to the comparison result to the stroke reference value determiner 10 as shown at step S21. In more detail, when the certain amplification ratio-multiplied first stroke estimation value is greater than the second stroke estimation value, the stroke compensation value calculator 20 generates a stroke compensation value for increasing the preset stroke reference value, and when the certain amplification ratio-multiplied first stroke estimation value is less than the second stroke estimation value, the stroke compensation value calculator 20 generates a stroke compensation value for decreasing the preset stroke reference value as shown at steps S22 and S23. Herein, the certain amplification ratio is obtained experimentally. In more detail, the certain amplification ratio is a ratio of a stroke value in a region at which current flows to the motor to a stroke value in a region at which current flowing to the motor is cut off.

Afterward, the stroke reference value determiner 10 adds/subtracts the counter electromotive force compensation value to/from the preset stroke reference value, determines the added/subtracted stroke reference value as a new stroke reference value and applies the determined stroke reference value to the comparator 30. In more detail, when the certain amplification ratio-multiplied first stroke estimation value is greater than the second stroke estimation value, the stroke reference value determiner 10 adds the stroke compensation value to the preset stroke reference value, determines the added stroke reference value as a new stroke reference value and applies the determined stroke reference value to the comparator 30. On the contrary, when the certain amplification ratio-multiplied first stroke estimation value is less than the second stroke estimation value, the stroke reference value determiner 10 subtracts the stroke compensation value from the preset stroke reference value, determines the subtracted stroke reference value as a new stroke reference value and applies the determined stroke reference value to the comparator 30.

The comparator 30 compares the determined stroke reference value with the first stroke estimation value and applies a difference value according to the comparison result to the stroke controller 40 as shown at step S24. Herein, the stroke controller 40 controls a stroke of the compressor 100 by varying a voltage applied to the motor on the basis of the difference value output from the stroke reference value determiner 10. For example, when the determined stroke reference value is greater than the first stroke estimation value, the stroke controller 40 increases a voltage applied to the motor of the compressor 100, and when the determined stroke reference value is less than the first stroke estimation value, the stroke controller 40 decreases a voltage applied to the motor of the compressor 100 as shown at steps S25 and S26.

Hereinafter, a method for detecting a counter electromotive force of the motor and a method for calculating a stroke estimation value of the compressor on the basis of the detected counter electromotive force value will be described in detail with reference to accompanying FIG. 5.

Figure 5:
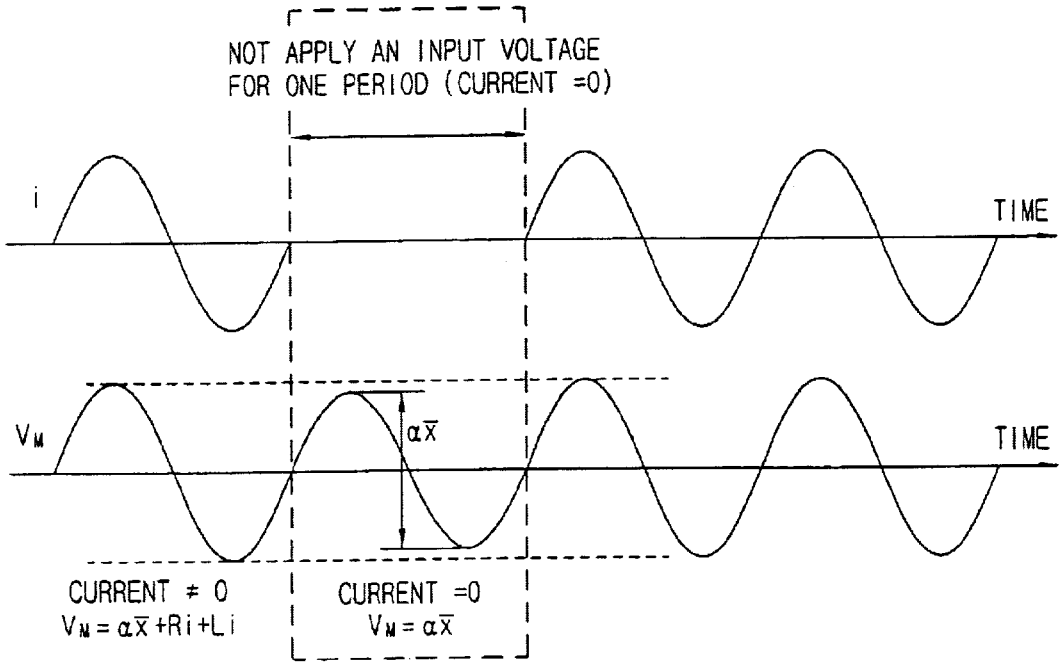
FIG. 5 is a wave diagram illustrating a point in time at which a counter electromotive force of a motor is detected in accordance with the present invention.

FIG. 5 is a wave diagram illustrating a point in time at which a counter electromotive force of a motor is detected in accordance with the present invention.

First, a first stroke estimation value is calculated on the basis of the voltage and current applied to the motor of the compressor 100 as well as the parameters of the motor and current applied to the motor is cut off for a period or periods greater than one period in order to detect a counter electromotive force while a stroke of the compressor 100 is controlled on the basis of the first stroke estimation value and a preset stroke reference value. Herein, a voltage of the motor is detected for the current cut-off period. A voltage detected at a point of time at which the current is cut off is a counter electromotive force. For example, when current applied to the motor of the compressor 100 is 0 (current=0), a voltage value ($V_M$) applied to the motor of the compressor 100 is the same as the detected counter electromotive force value. When the current applied to the motor of the compressor 100 is not 0 (current≠0), a voltage value ($V_M$) applied to the motor is calculated by an Equation $\alpha\bar{x}+Ri+L\dot{i}$. Accordingly, in order to remove deviation occurring due to resistance (R) and inductance (L), the current applied to the motor is temporarily cut off, a counter electromotive force (voltage) of the motor is detected at a point of time at which the current is cut off, the detected counter electromotive force value is substituted for Equation 3, and accordingly a second stroke estimation value of the compressor 100 can be accurately calculated regardless of deviation resulting from to the resistance (R) and inductance (L).

On the basis of the detected counter electromotive force, a second stroke estimation value is calculated, the first stroke estimation value is compared with the second stroke estimation value, and the preset stroke reference value is added or subtracted according to the comparison result. In more detail, a predetermined amplification ratio is multiplied by the first stroke estimation value, and the multiplied first stroke estimation value is compared with the second stroke estimation value. When the multiplied first stroke estimation value is greater than the second stroke estimation value, a stroke compensation value for increasing the preset stroke reference value is generated in order to compensate the preset stroke reference value. When the multiplied first stroke estimation value is less than the second stroke estimation value, a stroke compensation value for decreasing the preset stroke reference value is generated in order to compensate the preset stroke reference value.

Afterward, the compensated stroke reference value (which is the same as the determined stroke reference value) is compared with the first stroke estimation value, a voltage applied to the motor of the compressor 100 is varied according to the comparison result, and accordingly a stroke of the compressor 100 is controlled. In more detail, when the compensated stroke reference value is greater than the first stroke estimation value, a voltage applied to the motor is increased, and when the compensated stroke reference value is less than the first stroke estimation value, a voltage applied to the motor is decreased.

Accordingly, in the present invention, by compensating a preset stroke reference value on the basis of a first stroke estimation value calculated with current, a voltage applied to a motor of a compressor and parameters of the motor and a second stroke estimation value calculated with a counter electromotive force, it is possible to control a stroke of the compressor accurately and precisely on the basis of the compensated stroke reference value and the first stroke estimation value and to thus reduce a stroke estimation error.

As described above, in the present invention, by calculating a first stroke estimation value on the basis of current, a voltage applied to the motor of the compressor as well as the parameters of the motor, calculating a second stroke estimation value determined on the basis of a counter electromotive force of the motor and comparing the calculated first stroke estimation value with the second stroke estimation value, a stroke estimation error of the compressor can be reduced greatly.

In addition, in the present invention, by compensating a preset stroke reference value on the basis of a first stroke estimation value calculated with current, a voltage applied to the motor of the compressor as well as the parameters of the motor and a second stroke estimation value calculated in accordance with a counter electromotive force, comparing the compensated stroke reference value with the first stroke estimation value and controlling operation of the compressor according to the comparison result, operation of the compressor can be controlled accurately precisely.

What is claimed is:

1. A method for controlling operation of a compressor, comprising:

calculating a first stroke estimation value of a compressor based on the current, a voltage applied to a motor of the compressor and preset parameters of the motor;

detecting a counter electromotive force of the motor;

calculating a second stroke estimation value of the compressor based on the detected-counter electromotive force value;

determining a new stroke reference value by comparing a first stroke estimation value with the second stroke estimation value, one of adding and subtracting a stroke compensation value corresponding to the comparison result one of to and from a preset stroke reference value; and controlling a stroke of the compressor by varying a voltage applied to the motor based on the determined stroke reference value and the first stroke estimation value.

2. The method of claim 1, wherein the detecting a counter electromotive force comprises:

cutting off current applied to the motor for a predetermined period while a voltage applied to the motor is varied on the basis of the first stroke estimation value and the preset stroke reference value; and detecting a voltage of the motor for the current cut-off period.

3. The method of claim 1, wherein the second stroke estimation value is calculated based upon $$\frac{1}{\alpha}\int(\alpha\bar{x})dt,$$

wherein, $\alpha$ is a motor constant, $\bar{x}$ is a piston speed of the compressor, and $\alpha\bar{x}$ is the detected counter electromotive force value.

4. The method of claim 1, wherein determining the new stroke reference value comprises:

multiplying a predetermined amplification ratio by the first stroke estimation value;

comparing the multiplied first stroke estimation value with the second stroke estimation value and calculating a stroke compensation value as a difference value according to the comparison result; and one of adding and subtracting the stroke compensation value one of to and from the preset stroke reference value and utilizing the one of the added or subtracted stroke reference value as a new stroke reference value.

5. The method of claim 4, wherein the predetermined amplification ratio is a ratio of a stroke value in a region at which current flows to the motor to a stroke value in a region at which current flowing to the motor is cut off.

6. The method of claim 1, wherein the determining of the new stroke reference value comprises:

multiplying a predetermined amplification ratio by the first stroke estimation value;

adding the stroke compensation value to the preset stroke reference value when the predetermined amplification ratio-multiplied first stroke estimation value is greater than the second stroke estimation value and utilizing the added stroke reference value as a new stroke reference value; and subtracting the stroke compensation value from the preset stroke reference value when the predetermined certain amplification ratio-multiplied first stroke estimation value is less than the second stroke estimation value and utilizing the subtracted stroke reference value as a new stroke reference value.

7. The method of claim 1, wherein the controlling of the stroke comprises:

increasing a voltage applied to the motor when the determined stroke reference value is greater than the first stroke estimation value; and decreasing a voltage applied to the motor when the determined stroke reference value is less than the first stroke estimation value.

8. An apparatus for controlling operation of a compressor, comprising:

a detector that detects current and a voltage applied to a motor of a compressor;

a first stroke calculator that calculates a first stroke estimation value of the compressor based on the detected current value, voltage value and preset parameters of the motor;

a counter electromotive force detector that detects a counter electromotive force of the motor;

a second stroke calculator that calculates a second stroke estimation value of the compressor based on the basis of the counter electromotive force;

a stroke compensation value calculator that calculates a stroke compensation value based on the first stroke estimation value and the second stroke estimation value;

a stroke reference value determiner that one of adds and subtracts the stroke compensation value one of to and from a preset stroke reference value and utilizes one of the added and subtracted stroke reference value as a new stroke reference value; and a stroke controller that controls a stroke of the compressor by varying a voltage applied to the motor based on the first stroke estimation value and the determined new stroke reference value.

9. The apparatus of claim 8, wherein the counter electromotive force detector cuts off current applied to the motor for one of a period and periods not less than one period and detects a voltage of the motor for the current cut-off period.

10. The apparatus of claim 9, wherein the detected counter electromotive force value is calculated by $\alpha\bar{x}$, herein $\alpha$ is a motor constant, and $\bar{x}$ is a piston speed of the compressor.

11. The apparatus of claim 10, wherein the second stroke calculator calculates a second stroke estimation value of the compressor by substituting the detected counter electromotive force value for $$\frac{1}{\alpha}\int(\alpha\bar{x})dt$$

wherein, $\alpha\bar{x}$ is a counter electromotive force value detected from the motor.

12. The apparatus of claim 8, wherein the stroke compensation value calculator multiplies a, predetermined amplification ratio by the first stroke estimation value, compares the multiplied stroke estimation value with the second stroke estimation value and outputs a stroke compensation value corresponding to a difference value based on the comparison result.

13. The method of claim 12, wherein the predetermined amplification ratio is a ratio of a stroke value in a region at which current flows to the motor to a stroke value in a region at which current flowing to the motor is cut off.

14. The apparatus of claim 12, wherein the stroke reference value determiner adds the stroke compensation value to the preset stroke reference value when the predetermined amplification ratio-multiplied first stroke estimation value is greater than the second stroke estimation value and utilizes the added stroke reference value as a new stroke reference value, and the stroke reference value determiner subtracts the stroke compensation value from the preset stroke reference value when the predetermined amplification ratio-multiplied first stroke estimation value is less than the second stroke estimation value and utilizes the subtracted stroke reference value as a new stroke reference value.

15. The apparatus of claim 8, wherein the stroke controller increases a voltage applied to the motor when the determined stroke reference value is greater than the first stroke estimation value, and the stroke controller decreases a voltage applied to the motor when the determined stroke reference value is less than the first stroke estimation value.

* * * * *

UNITED STATES PATENT AND TRADEMARK OFFICE

CERTIFICATE OF CORRECTION

PATENT NO. : 6,815,922 B2
DATED : November 9, 2004
INVENTOR(S) : J.Y. Yoo et al.

It is certified that error appears in the above-identified patent and that said Letters Patent is hereby corrected as shown below:

Column 10,
Line 9, "a," should be -- a --.

Signed and Sealed this

Fifth Day of July, 2005

JON W. DUDAS
*Director of the United States Patent and Trademark Office*